United States Patent [19]

Herzog

[11] Patent Number: 5,007,228

[45] Date of Patent: Apr. 16, 1991

[54] ADJUSTABLE BOTTLE GRIPPER BELT

[76] Inventor: Kenneth Herzog, 135 Industrial Blvd., Riverhead, N.Y. 11901

[21] Appl. No.: 433,115

[22] Filed: Nov. 8, 1989

[51] Int. Cl.[5] ..... B65B 7/28; B67B 3/20

[52] U.S. Cl. ..... 53/282; 53/317; 53/331.5; 198/620

[58] Field of Search ..... 53/313, 314, 315, 316, 53/317, 331.5, 331, 287, 282; 198/627

[56] References Cited

U.S. PATENT DOCUMENTS

| | | | |
|---|---|---|---|
| 2,630,959 | 3/1953 | Brown | 53/314 |
| 2,777,562 | 1/1957 | McCahon et al. | 198/627 X |
| 3,438,174 | 4/1969 | Foss et al. | 53/314 X |
| 3,522,690 | 8/1970 | Zetterberg | 53/331.5 |
| 3,905,177 | 9/1975 | Herzog | 53/331.5 X |
| 4,095,390 | 6/1978 | Knudsen | 53/314 X |
| 4,559,760 | 12/1985 | Daniels et al. | 53/331.5 X |
| 4,690,265 | 9/1987 | Gayfer et al. | 198/627 X |

*Primary Examiner*—Horace M. Culver

[57] ABSTRACT

Apparatus for gripping a container when being capped in a container filling and capping machine is provided and consists of at least two adjustable container gripper belt assemblies oppositely suspended on a table top between a conveyor. The assemblies will grip the container during its travel therealong and prevent rotation of the container when the cap is applied onto a bottle neck of the container by a capping mechanism.

3 Claims, 1 Drawing Sheet

ADJUSTABLE BOTTLE GRIPPER BELT

BACKGROUND OF THE INVENTION

The instant invention relates generally to container filling and capping machines and more specifically it relates to an apparatus for gripping a container when being capped in a container filling and capping machine.

There are available conventional container filling and capping machines of various designs but which do not provide the novel improved functions and structure of the invention herein disclosed.

SUMMARY OF THE INVENTION

A primary object of the present invention is to provide an apparatus for gripping a container when being capped in a container filling and capping machine that will overcome the shortcomings of the prior art devices.

Another object is to provide an apparatus for gripping a container when being capped in a container filling and capping machine that will grip a container during its travel therealong and prevent rotation of the container when a cap is applied onto the container neck.

An additional object is to provide an apparatus for gripping a container when being capped in a container filling and capping machine whereby the belts of the apparatus can be horizontally adjusted to grip containers of varying sizes and shapes and where the bottle necks are off center on the containers, or where the container is narrower on top than on the bottom or visa versa.

A further object is to provide an apparatus for gripping a container when being capped in a container filling and capping machine that is simple and easy to use.

A still further object is to provide an apparatus for gripping a container when being capped in a container filling and capping machine that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
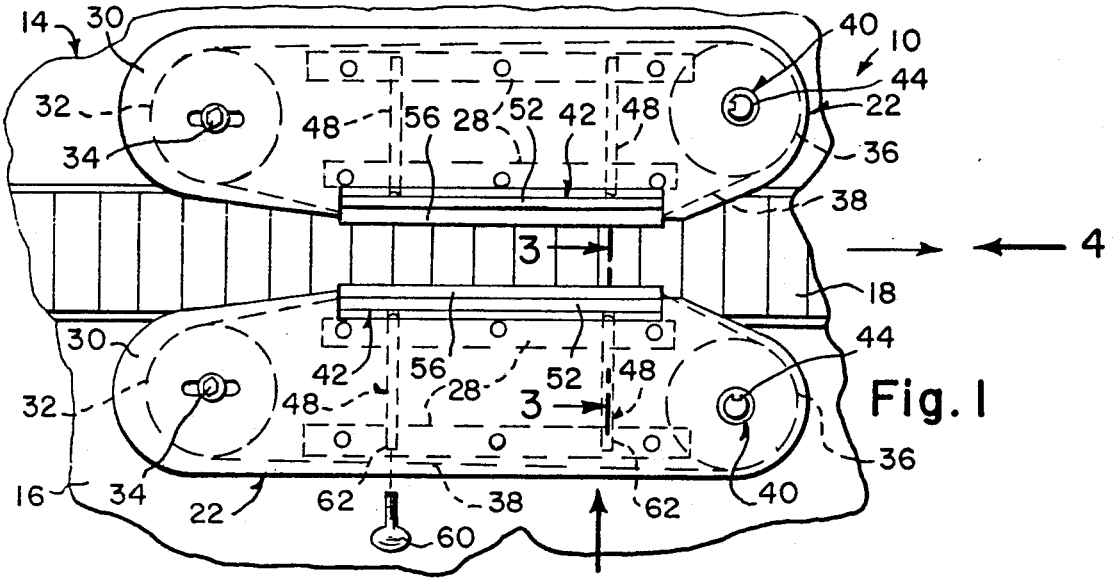
FIG. 1 is a top view of the invention.
Figure 2:
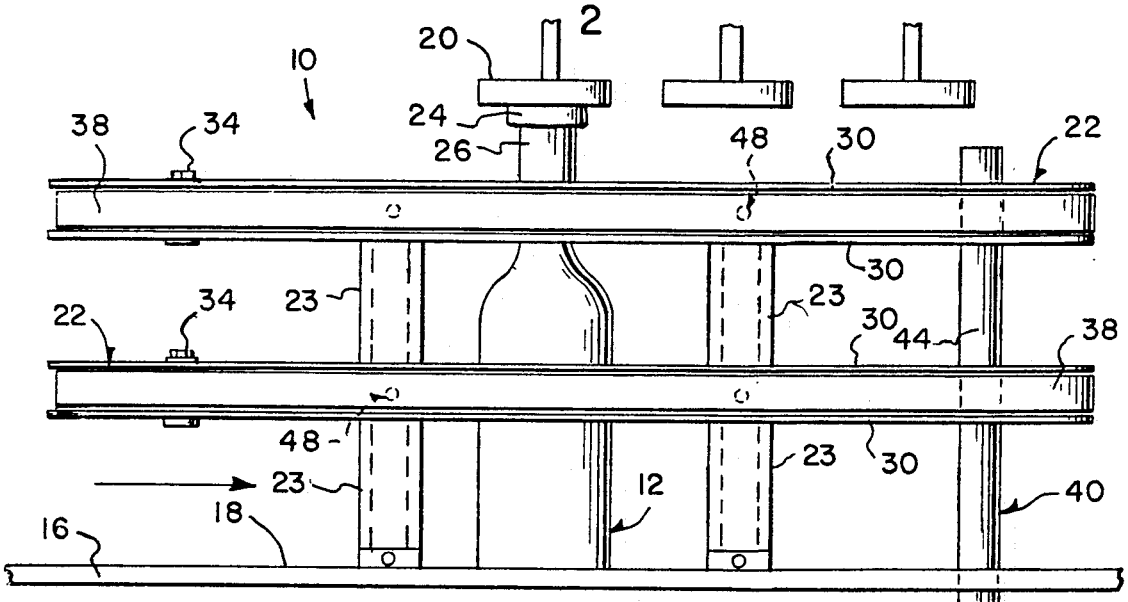
FIG. 2 is an elevational view taken in direction of arrow 2 in FIG. 1.
Figure 4:
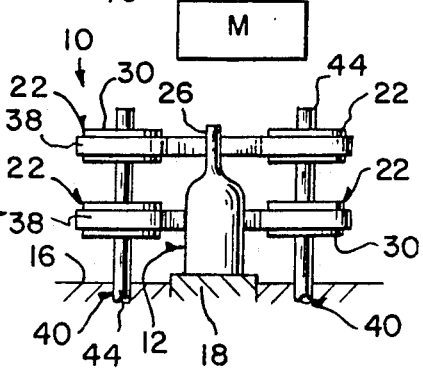
FIG. 4 is a diagrammatic side view of the invention as indicated by arrow 4 in FIG. 1.

Turning now descriptively to the drawings, in which similar reference characters denote similar elements throughout the several views, FIGS. 1, 2 and 4 illustrate an apparatus 10 for gripping a container 12 when being capped in a container filling and capping machine 14 of the type having a table top 16 with a conveyor 18 for allowing the container 12 to travel therealong and a capping mechanism 20 disposed above the conveyer 18. The apparatus 10 consists of at least two adjustable container gripper belt assemblies 22 oppositely suspended by spacers 23 on the table top 16 between the conveyor 18 so that the assemblies 22 will grip the container 12 during its travel therealong and prevent rotation of the container when a cap 24 is applied onto a bottle neck 26 of the container 12 by the capping mechanism 20.

Each adjustable container gripper belt assembly 22 includes a pair of horizontally spaced apart stationary bars 28 in parallel relationship to the conveyor 18. A pair of elongated plates 30 are mounted in a sandwiched relationship above and below the bars 28. An idler pulley 32 is adjustable and rotatably mounted at 34 between the plates 30 at one side thereof. A drive pulley 36 is rotatably positioned between the plates 30 at other side thereof. A continuous flexible gripper belt 38 extends about the idler pulley 32 and the drive pulley 36. A structure 40 is provided for rotatably driving the drive pulley 36 so that the gripper belt 38 will move at same speed as the conveyor 18. Another structure 42 is for horizontally adjusting the belt 38 over the conveyor 18 to engage with the container 12 of a varying size and shape.

The structure 40 includes a vertical drive shaft 44 connected to center of the drive pulley 36. A motor 46 is connected to the drive shaft 44 so as to rotate the drive shaft 44.

Figure 3:
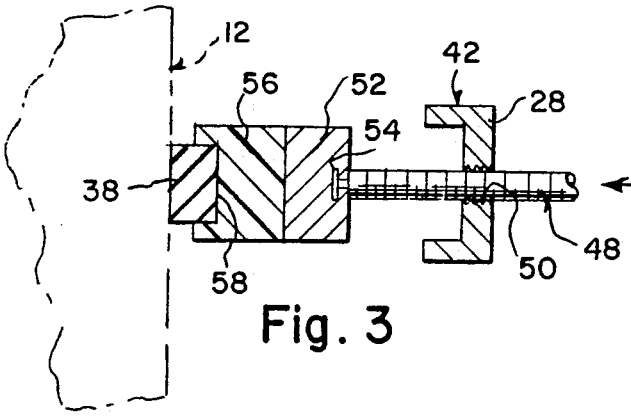
FIG. 3 is an enlarged cross sectional view taken along line 3—3 in FIG. 2, showing the internal structure of one of the container gripper assemblies in greater detail.

The structure 42, as shown in FIGS. 1 and 3, includes a pair of spaced apart elongated threaded shafts 48 extending through transversely threaded holes 50 in the stationary bars 28. A backing bar 52 is in parallel relationship with the forward stationary bar 28 so that forward ends 54 of the threaded shafts 48 can be rotatably mounted thereto. A wear strip 56 is carried on the backing bar 52 to bear against inner surface 58 of the gripper belt 38. A key 60 is removably engagable with rearward end 62 of each of the threaded shafts 48 so that each threaded shaft can be adjusted so that the gripper belt 38 will eventually bear against the container 12. It is noted that key 60, which is shown disproportionality large for clarity, can fit between the belt 38 and shaft 48 for access to end 62 of shaft 48.

For best results the belt 38 can be made out of rubber material, the wear strip 56 out of nylon material and the backing plate 54 out of metal material. Two sets of assemblies 22 are shown on each side of the conveyor 18 to best bear against the container 12 and its bottle neck 26 so as to stabilize the container.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. Apparatus for gripping a container when being capped in a container filling and capping machine of the type having a table top with a conveyor for allowing the container to travel therealong and a capping mechanism disposed above the conveyor, said apparatus comprising at least two adjustable container gripper belt assemblies oppositely mounted on the table top adjacent the conveyor so that said assemblies can be adjusted to grip containers of various sizes that travel on the conveyor and prevent rotation of the container when a cap is rotatably mounted onto a threaded bottle neck of the container by the capping mechanism, wherein each of said adjustable container gripper belt assemblies includes:

(a) a pair of horizontally spaced apart stationary bars mounted above the table top in parallel relationship to the conveyor;

(b) a pair of elongated plates mounted on the bars in a sandwiched relationship above and below said bars;

(c) an idler pulley being adjustable and rotatably mounted between said plates at one side thereof;

(d) a drive pulley rotatably positioned between said plates at the other side thereof;

(e) a continuous flexible gripper belt extending about said idler pulley and said drive pulley;

(f) means for rotatably driving said drive pulley so that said gripper belt will move at same speed as the conveyor;

(g) means mounted on each said bar below the container top for horizontally adjusting said belt of each said assembly to individually engage with containers of varying size and shape.

2. An apparatus as recited in claim 1, wherein said horizontally adjusting means includes:

(a) a pair of spaced apart elongated threaded shafts extending through transversely threaded holes in said stationary bars;

(b) a backing bar parallel to and forward of said forward stationary bar whereby forward ends of said threaded shafts are rotatably mounted on said backing bar;

(c) a wear strip carried on said backing bar adapted to engage said gripper belt and (d) means for rotating said shafts.

3. An apparatus as in claim 2, coacting in combination with similar assemblies each mounted on opposite sides of said conveyor and vertically aligned with each of the first said assemblies, whereby the vertical location of each second assembly is aligned to engage a reduced neck of the containers, thereby improving stability of the containers during capping.

* * * * *